US007507847B2

(12) United States Patent
Tou

(10) Patent No.: US 7,507,847 B2
(45) Date of Patent: Mar. 24, 2009

(54) QUALITY OF CRUDE OILS AND FATS AND RECOVERY OF MINOR COMPONENTS

(75) Inventor: Gee Ping Tou, Johor Bahru (MY)

(73) Assignee: Palm Nutraceuticals SDN. BND., Johor (MY)

( * ) Notice: Subject to any disclaimer, the term of this patent is extended or adjusted under 35 U.S.C. 154(b) by 203 days.

(21) Appl. No.: 11/336,454

(22) Filed: Jan. 20, 2006

(65) Prior Publication Data

US 2006/0189815 A1 Aug. 24, 2006

(30) Foreign Application Priority Data

Feb. 17, 2005 (MY) ..... PI 2005 0577

(51) Int. Cl.
*C11B 3/00* (2006.01)

(52) U.S. Cl. ..... 554/206; 554/207; 454/67

(58) Field of Classification Search ..... 554/207, 554/206; 435/67

See application file for complete search history.

(56) References Cited

U.S. PATENT DOCUMENTS

| | | | | |
|---|---|---|---|---|
| 4,359,417 | A | 11/1982 | Karnofsky et al. | |
| 4,594,437 | A * | 6/1986 | Sampathkumar | 549/413 |
| 5,078,920 | A * | 1/1992 | Maza | 549/413 |
| 5,157,132 | A | 10/1992 | Tan et al. | |
| 5,190,618 | A | 3/1993 | Top et al. | |
| 6,072,092 | A | 6/2000 | Ooi et al. | |
| 6,200,602 | B1 | 3/2001 | Watts et al. | |
| 6,596,306 | B1 | 7/2003 | Ho et al. | |
| 6,649,781 | B2 | 11/2003 | Tou | |

FOREIGN PATENT DOCUMENTS

| | | | |
|---|---|---|---|
| EP | 0333472 | A2 | 9/1989 |
| GB | 1515238 | | 6/1978 |
| GB | 2160874 | A | 1/1986 |
| GB | 2218989 | A | 11/1989 |
| GB | 2371545 | A | 7/2002 |
| GB | 2387390 | A | 10/2003 |

OTHER PUBLICATIONS

Norris, 1924, Experimental Organic Chemistry, McGraw-Hill Book Company Inc. pp. 3, 7-9, 11-12, 15.*

Chao, J. et al., "Inhibitory Effect of δ-Tocotrienol, a HMG CoA Reductase Inhibitor, on Monocyte-Edothelial Cell Adhesion," *J. Nutr. Sci. Vitaminol.* 2002; 48: 332-337.

Guthrie, N. et al., "Inhibition of Proliferation of Estrogen Receptor-Negative MDA-MB-435 and -Positive MCF-7 Human Breast Cancer Cells by Palm Oil Tocotrienols and Tamoxifen, Alone and in Combination," *J. Nutr.* 1997; 127: 544S-548S.

Inokuchi, H. et al., "Anti-angiogenic Activity of Tocotrienol," *Biosci., Biotech. Biochem.* 2003; 67(7): 1623-1627.

Khanna, S. et al., "Molecular Basis of Vitamin E Action," *J. Biol. Chem.* 2003; 278(44): 43508-43515.

Kooyenga, D.K. et al., "Palm oil antioxidant effects in patients with hyperlipidaemia and carotid stenosis-2 year experience," *Asia Pacific J. Clin. Nutr.* 1997; 6(1): 72-75.

Nesaretnam, K. et al., "Tocotrienols Inhibit the Growth of Human Breast Cancer Cells Irrespective of Estrogen Receptor Status," *Lipids* 1998; 33(5): 461-469.

Nesaretnam, K. et al., "Tocotrienols inhibit growth of ZR-75-1 breast cancer cells," *Int. J. Food Sci. Nutr.* 2000; 51 *Suppl.* S95-103.

Parker , R.A. et al., "Tocotrienols Regulate Cholesterol Production in Mammalian Cells by Post-transcriptional Suppresion of 3-Hydroxy-3-methylglutaryl-Coenzyme A Reductase," *J. Biol. Chem.* 1993; 268(15): 11230-11238.

Pearce, B.C. et al., "Hypocholesterolemic Activity of Synthetic and Natural Tocotrienols," *J. Med. Chem.* 1992; 35: 3595-3606.

Qureshi, A.A. et al., "Lowering of serum cholesterol in hypercholesterolemic human by tocotrienols (palmvitee)," *Am. J. Clin. Nutr.* 1991: 53, 1021S-1026S.

Qureshi, A.A. et al., "Response of Hypercholesterolemic Subjects to Administration of Tocotrienols," *Lipids* 1995, 30(12): 1171-1177.

Qureshi, A.A. et al., "Dose-dependent suppression of serum cholesterol by tocotrienol-rich fraction ($TRF_{25}$) of rice bran in hypercholesterolemic humans," *Atherosclerosis* 2002; 161: 199-207.

Saito, H. et al., "γ-Tocotrienol, a vitamin E homolog, is a natriuretic hormone precursor," *J. Lipid Res.* 2003; 44: 1530-1535.

Sen, C.K. et al., "Molecular Basis of Vitamin E Action. Tocotrienol potentially inhibits glutamate induced $pp60^{c\text{-}Src}$ kinase activation and death of HT4 neuronal cells," *J. Biol. Chem.* 2000;275(17): 13049-13055.

Theriault, A. et al., "Tocotrienol: Review of Its Therapeutic Potential," *Clin. Biochem.* 1999; 32(5): 309-319.

Yu, W. et al., "Induction of Apoptosis in Human Breast Cancer Cells by Tocopherols and Tocopherols and Tocotrienols," *Nutr Cancer* 1999; 33(1): 26-32.

* cited by examiner

*Primary Examiner*—D. Margaret Seaman
*Assistant Examiner*—Nizal S Chandrakumar
(74) *Attorney, Agent, or Firm*—Wolf, Greenfield & Sacks, P.C.

(57) ABSTRACT

The present invention discloses a process for the recovery of minor components from oils and fats without destroying the natural components and simultaneously improving the quality of vegetable oils and fats.

20 Claims, No Drawings

QUALITY OF CRUDE OILS AND FATS AND RECOVERY OF MINOR COMPONENTS

TECHNICAL FIELD OF THE INVENTION

This invention relates to a novel process for the recovery of minor components from oils and fats without destroying the natural components in the oils or fats and at the same time improving the quality of vegetable oils and fats. More specifically, the invention is concerned with the separation and removal of triacylglycerols and diacylglycerols, partial separation and removal of free fatty acids, sterols monoacylglycerols and other components from the tocotrienols by liquid-liquid extraction, urea inclusion compound formation and fractionation, followed by vacuum distillation to further separate free fatty acids and monoacylglycerols to obtain tocotrienol concentrate. The oils and fats after the processes described in this invention are better in quality as compared to the original oils and fats based on the current trade specifications.

BACKGROUND OF THE INVENTION

Tocotrienols are members of the vitamin E family. In nature, twelve members of the vitamin E family are known, collectively they are called tocols. These are α-, β-, γ- and δ-tocopherols, α-, β-, γ- and δ-tocotrienols, desmethyltocotrienol, didesmethyltocotrienol and two isomers of α-tocomonoenol. Tocopherol has saturated phytyl side chain attached to the chroman ring whereas tocotrienol has three double bonds in the farnesyl side chain. Tocomonoenol has a single double bond in the hydrocarbon side chain. Besides the side chain, tocopherols, tocomonoenols and tocotrienols share the similar chemical structure of having a chroman ring.

α-Tocol refers to tocol with positions 5, 7 and 8 of the chroman ring substituted by methyl groups, whereas β-tocol refers to tocol with positions 5 and 8 of the chroman ring substituted by methyl groups, γ-tocol refers to tocol with positions 7 and 8 of the chroman ring substituted by methyl groups and δ-tocol refers to tocol with position 8 of the chroman ring substituted by a methyl group.

Unlike tocopherols, little attention was paid to tocotrienols until the last decade. This is not surprising as the sources of tocotrienols are very limited. However, recent research findings revealed that tocotrienols have good chemo-preventive properties that are not shared with tocopherols. Some of the research findings include

- anti-angiogenic properties potentially for inhibiting growth and proliferation of cancer cells (Inokuchi et al, 2003, *Biosci., Biotech. Biochem.*, 67, 1623-1627),
- inducing apoptosis of human breast cancer cells (Guthrie et al, 1997, *J. Nutr.* 127, 544S-548S; Nesaretnam et al, 1998, *Lipids*, 33, 461-469; Yu et al, 1999, *Nutr Cancer*, 33, 26-32; Nesaretnam et al, 2000, *Int. J. Food Sci. Nutr.* 51 Suppl. S95-103; Chao et al, 2002, *J. Nutr. Sci. Vitaminol.* 48: 332-337;),
- natriuretic (Saito et al, 2003, *J. Lipid Res.* 44, 1530-1535),
- cholesterol lowering (Pearce et al, 1992, *J. Med. Chem.* 35, 526-541 & 3595-3606; Parker et al, 1993, *J Biol, Chem.* 268, 11230-11238; Qureshi et al, 1995, *Lipids*, 30, 1171-1177; Theriat et al, 1999, *Clin. Biochem.* 32, 309-319; Chao et al, 2002, *Nutr. Sci. Vitaminol.* 48, 332-337; Qureshi et al, 2002, *Atherosclerosis*, 161, 199-207),
- anti-platelet aggregation (Qureshi et al, 1991, *Am. J. Clin. Nutr.*, 53, 1021S-1026S),
- regression of carotid stenosis (Kooyenga et al, 1997, *Asia Pacific J. Clin. Nutr*, 6, 72-75),

- neuro-protection against glutamate induced toxicity (Sen et al, 2000, *J. Biol. Chem.* 275, 13049-13055; .Khanna et al, 2003, *J. Biol. Chem.* 278, 43508-43515).

These research findings also implicated the potential of tocotrienols in substituting for established drugs like tamoxifen, aspirin and statins or use in combination with these drugs. The advantages of tocotrienols over the drugs include their multi-functional therapeutic properties, no known side effects and no known overdose toxicity was reported.

Unlike tocopherols, the sources of tocotrienols are scarce in nature. It is unlikely that significant amount of tocotrienols can be derived by normal food intake. Tocotrienols are found in low levels in palm oil, rice bran oil, barley, wheat germ, rye, coconut oil and palm kernel oil. There are three known commercial sources of tocotrienols—palm oil, rice bran oil and annatto bean.

Crude palm oil contains 600-1000 ppm of tocols and is the most reliable commercial source of tocotrienols. The current annual world production of crude palm oil exceeded twenty million tonnes and is growing steadily. Palm oil mainly consists of triacylglycerols. The other components include 1-5% free fatty acids, 4-7.5% diacylglycerols and minor components such as monoacylglycerols, sterols, glycolipids, phospholipids, squalene, carotenoids, other hydrocarbons and triterpene alcohols. Based on the current trade specifications, crude palm oil quality specifications comprising of three parameters, free fatty acid contents, moisture and impurities contents and a recently included locally developed parameter called deterioration of bleachability index (DOBI).

The current world production of rice bran oil is estimated to be less than one million tonnes and the bulk being of industrial grade. The annual production of annatto beans was about ten thousand tonnes for the year 1992.

The tocols composition in palm oil has advantages over that of rice bran oil. Almost half of the tocols from rice bran oil is tocopherols whereas tocopherol content in palm oil constituted about 22%. In addition, rice bran oil practically does not contain δ-tocotrienol. δ-Tocotrienol was reported to have the highest potency amongst all the tocols in anti-angiogenesis, inducing apoptosis and in prevention of cardio-vascular diseases. δ-tocotrienol constituted about 12% in the tocols derived from palm oil. Although tocotrienol from annatto beans is rich in δ-tocotrienol, however it does not contain α-tocotrienol. α-Tocotrienol was reported to have the highest neuro-protection activity.

One main concern on tocotrienols is the poor absorption in the blood and/or lymphatic systems and their bioavailability. It is known that the absorption of tocotrienols is poor without the presence of dietary fat to stimulate the secretion of bile and lipases. U.S. Pat. No. 6,200,602 described formulation using monoacylglycerol and diacylglycerol of medium chain fatty acids and a dispersing agent to enhance the uptake of polar drugs from the colon whereas U.S. Pat. No. 6,596,306 described formulations using surfactants (labrasol™ and Tween 80™), palm olein and soybean oil to enhance the tocotrienol delivery system.

As tocotrienols are present in minute quantity in oils and fats, the triacylglycerols have to be separated or removed in order to increase the concentration of tocotrienols. This can be achieved by transesterification or solvent extraction. Other minor components have to be removed in order to enrich further on the tocotrienol concentration.

There are patents describing the production of tocotrienols from vegetable oils and fats. Most of these patents involved transesterification of the oil or fat prior to recovery of tocotrienols, followed by vacuum distillation and post-distillation treatment such as using adsorbents. These include U.S. Pat.

Nos. 5,157,132, 6,072,092, 5,190,618, European Patent No. 0333472A2, U.K. Patent Nos. GB2218989A, GB2160874A and GB1515238.

There were many examples of using solvent extraction to remove impurities or undesired components from oil seeds and solvent oil miscella. Examples of the applications include U.S. Pat. No. 4,359,417 described a process using aqueous methanol for removing aflatoxin and/or gossypol from the residue meal of oil seed. IL58842 described a process involving extraction of hydrocarbon solvent oil miscella with aqueous methanol or ethanol. These inventions were not aimed at the recovery of components of interest of this invention.

There were patents describing the production of tocotrienols from vegetable oils and fats by an alcohol extraction followed by short path distillation. These include U.K. Patent No. GB2387390 and U.S. Pat. No. 6,649,781. The main disadvantages of these patents include low tocotrienol concentration obtained and relatively large volume of solvent was used during the extraction. Fatty acids and diacylglycerols were the main components in the alcohol extract and were removed by vacuum distillation.

Urea is a weak base. Solubility of urea in methanol is 35 g per 100 mL at 40° C. Urea can react with free fatty acids to form salts but this reaction is very slow and not significant under the conditions of this invention. These characteristics enabled urea solution in methanol to be used for liquid-liquid extraction; although strictly speaking, palm oil is a semi-solid, not a true liquid, but effective extraction can still be achieved by dispersing the semi-solid palm oil into fine droplets. In addition, urea forms urea inclusion compounds with hydrocarbons, fatty acids, fatty acid methyl esters and monoacylglycerols. Urea inclusion compound formation is a useful technique for concentrating certain fatty acids. The selective urea inclusion compound is based on the principle that certain categories of fatty acids formed urea inclusion compound in preference to other fatty acids, while branched chain and fatty acids with cyclic ring do not form urea inclusion complex.

SUMMARY OF THE INVENTION

This invention relates to the process of producing tocotrienol concentrate from oils and fats and has particular but not exclusive application to the process producing tocotrienol concentrate, free fatty acids, monoacylglycerols and diacylglycerols from crude palm oil and its fractionated products without destroying the oils and fats and improving the quality of crude oils and fats.

This invention has many advantages. The oil after partial removal of tocols, sterols, free fatty acids, monoacylglycerols, diacylglycerols, phospholipids, glycolipids and other impurities including odoriferous materials can be easier to refine as compared to the original oil or fat. Therefore the oil or fat can be refined using less stringent conditions and still be used for edible application. Although a portion of tocols have been removed, the less stringent refining conditions shall prevent much larger quantity of tocols being adsorbed into bleaching earths, degraded by higher temperature and being downgraded in the non-food palm fatty acid distillates in a palm oil refinery. U.K. Patent No. 2371545 and U.S. Pat. No. 6,649,781 described a process of refining vegetable oils and fats using lower bleaching earth dosage and milder conditions after removing those polar components.

This invention enables tocols to be pre-concentrated to a high concentration (more than 30%) prior to vacuum distillation. A smaller vacuum distillation plant is therefore sufficient for a fixed throughput. This has significant capital cost saving as vacuum distillation plants such as short path distillation plants are very expensive. Basically, the polar components are extracted with an alcoholic urea solution and non-tocols components such as residual triacylglycerols, diacylglycerols, the bulk of free fatty acids, monoacylglycerols and sterols are removed by a fractionation process of urea inclusion compound formation, crystallization/precipitation and filtration. Free fatty acids and monoacylglycerols, especially the saturated ones, formed urea inclusion compounds whereas the rest of the undesired components are crystallized/precipitated and separated by filtration. Tocols remain un-solidified in alcoholic solutions. However, it should be noted that tocotrienols, especially the more polar and more acidic δ-tocotrienol have high affinity to adhere to the crystallized solids.

In the absence of urea, the presence of free fatty acids and diacylglycerols are known to interfere with crystallization. These components are highly undesired in raw material for fractionation in the palm oil industry. In the present invention, the presence of urea and urea inclusion compounds have acted as seeding materials, induced crystal formation/precipitation and crystal growth. The efficient removal of undesired components via urea inclusion complex and crystallization/precipitation with subsequent filtration enable high concentration (more than 30%) of tocols to be obtained prior to short path distillation.

As there was no transesterification step involved, residual fatty acid methyl esters in tocotrienol concentrate are not of concern. Fatty acid methyl ester when ingested can be hydrolyzed into fatty acid and methanol, subsequently methanol metabolism involves conversion into formaldehyde and formic acid by hepatic alcohol and aldehyde dehydrogenase respectively in human body. Formaldehyde and formic acid are undesirable and toxic to human body.

This invention enables tocols to be distilled at relatively very low temperature (at 135° C.) and the tocols are not subjected to higher temperature than 150° C. at all times. There is no need for further processing (such as post-distillation fractionation and/or adsorption chromatography) after vacuum distillation step. High tocotrienol concentrations (50% minimum) are achievable.

This invention also enables the production of tocotrienol concentrate with better composition than that in the original oils and fats. Tocotrienols to α-tocopherol ratio obtained by the present invention is about 8:1 as compared to the reported ratio of 7:3 for palm oil. A low α-tocopherol content in tocotrienol concentrate is desired in view of the recent John Hopkins researchers report (Miller et al, *Annals of Internal Medicine* online 10 Nov. 2004) that re-analysis of previous 19 trials that took place between 1993 and 2004 by meta-analysis indicated that high dose α-tocopherol supplements may increase risk of dying for old patients, majority had pre-existing conditions such as heart disease and high concentration of α-tocopherol attenuated the ability of tocotrienols in cholesterol lowering actions (Qureshi et al, 1996, *J. Nutr.* 126: 389-394). δ-Tocotrienol constituted about 19% in the tocotrienol concentrate is also significantly higher than that presence in crude palm oil (about 12%). δ-Tocotrienol is the most potent tocotrienol in anti-angiogenesis (Inokuchi et al, 2003, *Biosci., Biotech. Biochem.*, 67, 1623-1627) and in inducing apoptosis (Chao et al, 2002, *J. Nutr. Sci. Vitaminol.* 48: 332-337).

Besides the tocols, the other major component of tocotrienol concentrate is monoacylglycerol, mainly in the form of monoolein. Monoacylglycerols are natural food emulsifier and it is naturally produced during the digestion of dietary fat in our body. Thus monoacylglycerols can avoid the problem of poor absorption due to insufficient dietary fat to stimulate the secretion of bile and lipases as monoacylglycerols are the products for the actions of bile and lipases.

The primary object of the present invention is to provide a process for the recovery of free fatty acids, tocols, monoacylglycerols and diacylglycerols from crude vegetable oils and fats without destroying the naturally occurring components in the crude vegetable oils and fats and improving the quality of the original oils and fats after the recovery of minor components.

These and other objects of the present invention are accomplished by providing,

A process for the recovery of tocols from oils and fats without destroying the naturally occurring components in the oils and fats and improving the quality of the oils and fats, said process comprising the steps of:

a) liquid-liquid extraction of oils and fats with an urea solution in methanol or ethanol or a methanol-ethanol mixture;
b) subjecting the alcoholic extract obtained in step (a) to temperature between 0 and −25° C.;
c) separating of the solids and liquid obtained in step (b) by filtration;
d) concentrating the filtrate obtained in step (c) by partial removal of solvent;
e) adding a hydrocarbon solvent to the contents obtained in step (d), and separating the solids obtained from the hydrocarbon-methanol layers by filtration or decanting;
f) separating the hydrocarbon layer by draining away the lower methanol layer, washing the hydrocarbon layer with water, and further separating the hydrocarbon solvent layer by draining away the water layer;
g) solvent removal of the hydrocarbon layer obtained in step (f) by low vacuum distillation;
h) distilling the contents obtained in step (g) at about 85-100° C., 0.1 Pa; preferably at about 90-100° C., 0.1 Pa to remove free fatty acids as distillate;
i) distilling the residue obtained in step (h) at about 100-170° C., 0.1 Pa; preferably at about 100-150° C., 0.1 Pa; more preferably at about 135° C., 0.1 Pa; to obtain tocotrienol concentrate as distillate;
j) washing thoroughly the residue obtained in step (c) with methanol or ethanol or methanol-ethanol mixture;
k) solvent removal of the alcoholic solution obtained in step (j);
l) dissolving the contents obtained in step (k) in hydrocarbon solvent, washing the solution with water, and separating the hydrocarbon solvent layer by draining away the water layer;
m) solvent removal of the hydrocarbon layer obtained in step (l) by low vacuum distillation;
n) distilling the contents obtained in step (m) at about 85-100° C., 0.1 Pa; preferably at about 90-100° C., 0.1 Pa to remove free fatty acids as distillate; and
o) distilling the residue obtained in step (n) at about 100-170° C., 0.1 Pa; preferably at about 100-150° C., 0.1 Pa; more preferably at about 135° C., 0.1 Pa; to obtain tocotrienol concentrate as distillate.

and

A process for the recovery of fatty acids, monoacylglycerols and diacylglycerols from oils and fats without destroying the naturally occurring components in the oils and fats and improving the quality of oils and fats, said process comprising the steps of:

a) adding a hydrocarbon solvent to the residue obtained in step (j) of Claim 1 and filtering the resulting solution;
b) solvent removal of the contents soluble in hydrocarbon solvent obtained in step (a) by low vacuum distillation to obtain a mixture of fatty acids, monoacylglycerols, diacylglycerols and sterols;
c) distilling the mixture obtained in step (b) at about 85-100° C., 0.1 Pa; preferably at about 90-100° C., 0.1 Pa; to remove free fatty acids as distillate;
d) distilling the residue obtained in step (c) at about 100-170° C., 0.1 Pa; preferably at about 100-150° C., 0.1 Pa; more preferably at about 135° C., 0.1 Pa to obtain monoacylglycerols concentrate as distillate; and
e) distilling the residue obtained in step (d) at about 170° C. or greater, 0.1 Pa; preferably at about 175° C., 0.1 Pa to obtain diacylglycerols concentrate as distillate.

This invention will be clearly understood and apparent with reference to the detailed description which follows.

DETAILED DESCRIPTION OF THE INVENTION

The features and details of the invention, either as steps of the invention or as combinations of parts of the invention will now be described. It will be understood that the particular embodiments of the invention are shown by way of illustration and not as limitations of the invention. The principle features of the invention may be employed in various embodiments without departing from the scope of the invention.

The polar and non-polar components of crude oils and fats are separated by extraction with urea solution in methanol or ethanol. Oils and fats and alcoholic urea solution form two phases. The non-polar components such as carotenes, squalene and other hydrocarbons preferentially remained in the oil whereas the polar components such as free fatty acids, monoacylglycerols, diacylglycerols, tocols, sterols, glycolipids, phospholipids and oxidized materials are preferentially partitioned into the polar urea solution.

Conveniently, counter current liquid-liquid extractor can be used for extraction of polar components from crude palm oil. Oils and fats such as crude palm oil is pumped and dispersed into small droplets from the top of the counter current liquid-liquid extractor. The alcoholic urea solution is continuously pumped into the extractor from the bottom. The pumping rates of crude palm oil and urea solution are controlled independently by metering pumps. The dispersion and mixing are performed by agitator action throughout the length of the extractor column equipped with a series of impellers with flat blade discs. After each rotating disc, there is a settling zone. The settling zones are separated from the mixing zones by a vertical baffle running through the entire extracting column. The denser crude palm oil traveled from the top of the extractor, repeatedly dispersed and settled until it reached the bottom of the extractor. The raffinate is discharged into a collecting vessel from the bottom valve. The less dense extract traveled continuously upwards until it reached the top, overflowed into a collecting vessel. The raffinate can be recycled and fed into the extractor repeatedly if it is preferred to extract further for better recovery of the polar components.

The residual alcohol in the raffinate is removed by passing through a vacuum dryer. The residual urea in crude palm oil can be washed with water and the residual water can be removed by clarification, polishing and vacuum drying as per standard practice in a palm oil mill. The crude palm oil recovered from the raffinate is of better quality than the original crude palm oil in terms of the trade specifications. The standard quality parameters in current contractual trade specifications for crude palm oil are free fatty acid content (5.0% maximum), moisture and impurities (0.25% maximum) content and DOBI (2.3 minimum). The recovered crude palm oil typically has almost half the content of free fatty acids, removed almost all the impurities and improved the DOBI value by nearly 0.5 units after a single pass liquid-liquid extraction of crude palm oil. There is no difference in the moisture content between the recovered and original crude palm oil. The improved quality crude palm oil can be easily refined in the palm oil refinery.

The alcoholic urea extract is subjected to low temperature (0 to −25° C.) treatment. Urea inclusion compounds, crystallization and precipitation of high melting components took place. The low temperature reduced the solubility of residual triacylglycerols in the alcoholic solution, causing phasing out of residual triacylglycerols and formed a solid layer at the bottom. For other components, urea inclusion compounds are preferentially formed first. This is demonstrated by using low urea concentration (1% w/v) in methanol as the extracting solvent and in this case, very little solids were formed and insignificant removal of free fatty acids, monoacylglycerols and diacylglycerols resulting in a relatively low tocols concentration (1.5% w/w) in the extract after removal of solvent. Gas liquid chromatogram (GLC) revealed that mainly the saturated fatty acids and saturated monoacylglycerols were removed.

At higher urea concentration (10% w/v), more solids were formed. After filtration and solvent removal by vacuum distillation, a relatively high tocols concentration (30-35%) can be achieved. This high tocols concentration obtained without undergoing esterification or saponification of oils and fats prior to short path distillation is unique in this invention and had not been reported before. GLC revealed that practically all diacylglycerols and the bulk of free fatty acids, monoacylglycerols and sterols are removed by urea inclusion compounds, crystallization or precipitation.

The functions of methanolic urea solution in the present invention are beyond just as medium for extraction and urea inclusion compound but very importantly, removed the other non-tocols components such as diacylglycerols and sterols presumably by reducing their solubility in the matrix resulting in crystallization and/or precipitation and eliminating the formation of euthetic mixtures with free fatty acids and diacylglycerols.

The crystallization inhibiting effect of free fatty acids and diacylglycerols have to be overcome first in the case where free fatty acids and diacylglycerols are the major components in the matrix. The ability to induce crystallization requires solute concentration sufficient for nucleation to occur and continues at concentration beneath the nucleation threshold. The following demonstrating the ineffectiveness to concentrate tocols in the cases where low urea concentrations were used:

| Urea in methanol % w/v | α-T % w/w | α-$T_3$ % w/w | β-$T_3$ % w/w | γ-$T_3$ % w/w | δ-$T_3$ % w/w | Total tocols % w/w |
|---|---|---|---|---|---|---|
| 0% | 0.1 | 0.2 | 0.02 | 0.3 | 0.1 | 0.7 |
| 1% | 0.2 | 0.4 | 0.02 | 0.7 | 0.3 | 1.5 |
| 2.5% | 0.4 | 0.7 | 0.05 | 1.2 | 0.6 | 2.9 |
| 5% | 0.5 | 1.1 | 0.08 | 1.7 | 0.9 | 4.2 |
| 10% | 4.5 | 9.4 | 0.8 | 14.6 | 5.9 | 35.2 |

T denotes tocopherol whereas $T_3$ denotes tocotrienols n-Hexane is added to the residue after the methanol washing. Free fatty acids, monoacylglycerols, diacylglycerols and sterols are recovered in the n-hexane layer after removal of the solvent by vacuum distillation. Urea is recovered as the residue.

The tocols concentration can be increased by short path distillation. The feed for distillation is fed into a rotating distributor disc attaching the wiper basket by a metering pump. The material was distributed onto the heated shell by the rotating disc and wiped into thin film by rollers attached to the wiper basket. The wiper basket was set at 300 revolutions per minute. The internal condenser temperature was controlled using a circulation warm water pump equipped with temperature controller (set at 60° C.). Distillation temperature is controlled by a hot oil heater equipped with a temperature controller and pump for circulation hot oil to the jacketed shell of the short path evaporator. A cold finger set at −90° C. was used as the cold trap. Vacuum (0.1 Pa) was achieved by a combination of rotary vane pump and oil diffusion pump.

Short path distillation at 90° C., 0.1 Pa at a low feed rate of 50 g/hour can distill off the free fatty acids without distilling the tocols. Distillation under these conditions can be carried out repeatedly in the same or different short path evaporator (s) until practically all the free fatty acids are removed. Tocols are distilled at less than 135° C. at 0.1 Pa if diacylglycerols are present in the feed material. At 135° C., 0.1 Pa, practically all the diacylglycerol remained in the residue, the distillate is tocols concentrate. In the case where diacylglycerols are absent in the feed, distillation temperature can be higher than 135° C. at 0.1 Pa, preferably below 150° C. At higher distillation temperature under the same feed rate, the ratio of distillate to residue increases and higher throughput is achievable. After distillation of the tocols, diacylglycerols can be distilled and collected as distillate above 170° C., 0.1 Pa.

DESCRIPTION OF PREFERRED EMBODIMENTS

The present invention will now be further specifically described by the following examples. All parts and percentages are by weight unless otherwise stated.

Example I

Liquid-liquid extraction was performed by pumping 8.5 L/hour of 10% urea in methanol solution as the lighter phase and 4.5 kg/hour crude palm oil (free fatty acid content 3.65%, DOBI value 2.30), pre-heated at 45° C., as the heavier phase. The agitator was set at 900 revolutions per minute. The raffinate collected was found to contain 17% (w/w) of urea solution. After removing the entrenched urea solution by rotary evaporation to recover the methanol, washing and rotary evaporation again, 9.0 kg of crude palm oil was obtained. Free fatty acid content 1.93%, DOBI value 2.78. 15 L alcoholic urea extract was obtained. 6 L of the alcoholic extract was allowed to crystallize at −15° C. for 40 hours.

The contents were rapidly filtered by vacuum suction to obtain a filtrate (F1) and a residue (R1). F1 was rotary evaporated until solids started to form. The concentrated filtrate was transferred to a beaker. Two volumes (300 mL) of n-hexane were added. Urea precipitated out (27.8 g) and the clear n-Hexane and methanol are separated in a separating funnel. The n-hexane layer was washed with water, separated and rotary evaporated to dryness. 1.25 g of oily paste was obtained with total tocols concentration of 32.4%. The individual tocols concentration determined by HPLC were 3.2, 9.1, 0.6, 13.3 and 6.2% (w/w) for α-tocopherol, α-tocotrienol, β-tocotrienol, γ-tocotrienol and δ-tocotrienol respectively. The relative composition of α-tocopherol, α-tocotrienol, β-tocotrienol, γ-tocotrienol and δ-tocotrienol in the tocols were calculated to be 9.9, 28.1, 1.9, 41.0 and 19.1% respectively. GLC revealed the absence of diacylglycerols and triacylglycerols. Free fatty acid constituted 8.7%, monoacylglycerols constituted 6.2%, β-sitosterol constituted 7.1%.

R1 was washed twice with one volume (150 mL) each of cold methanol. The filtrate (F2) was rotary evaporated until solids started to form. The concentrated filtrate was transferred to a beaker. Two volumes (200 mL) of n-hexane were added. Urea precipitated out (564 g) and the clear n-Hexane and methanol are separated in a separating funnel. The n-hexane layer was washed with water, separated and rotary evaporated to dryness. 26.2 g of clear oil containing 0.78% of tocols was obtained. The individual tocols concentration determined by HPLC were 0.07, 0.21, 0.01, 0.32 and 0.15% (w/w) for α-tocopherol, α-tocotrienol, β-tocotrienol, γ-tocotrienol and δ-tocotrienol respectively. The relative composition of α-tocopherol, α-tocotrienol, β-tocotrienol, γ-tocotrienol and δ-tocotrienol in the tocols were calculated to be 9.8, 27.4, 1.7, 41.5 and 19.6% respectively. GLC revealed that the other main components were free fatty acids, monoacylglycerols and diacylglycerols.

Example II 73.9 g of feed materials containing 1.1% tocols was distilled using short path evaporator at 50 g/hour feed rate (diaphragm pump setting at 30% stroke length at 10 dosing pulses per minute), roller basket at 300 revolution per minute, internal condenser at 50° C., short path evaporator temperature at 100° C., vacuum 0.1 Pa, cold trap at −90° C. The tocols concentration increased to 2.2%. GLC revealed that free fatty acids were distilled but tocotrienols were not detected in the distillate.

The residue is re-distilled under the same conditions except the short path evaporator temperature at 135° C., residual free fatty acids, monoacylglycerols, tocols and sterols were collected as the distillate. GLC revealed that the diacylglycerols were not distilled at 135° C., 0.1 Pa. The tocols concentration obtained was 12.0%. When the short path evaporator temperature was increased to 160° C., diacylglycerols was distilled over together with residual free fatty acids, monoacylglycerols, tocols (15.8%) and sterols. The residue contained 0.06% tocols.

It should be understood that the preceding is merely a detailed description of certain preferred embodiments. It therefore should be apparent to those skilled in the art that various modifications and equivalents can be made without departing from the spirit and scope of the invention. It is intended to encompass all such modifications within the scope of the appended claims.

All references, patents and patent publications that are recited in this application are incorporated in their entirety by reference.

The invention claimed is:

1. A process for the recovery of tocols from oils and fats, said process comprising of the steps of:

a) liquid-liquid extraction of oils and fats with urea solution in methanol or ethanol or methanol-ethanol mixture;

b) subjecting the alcoholic extract obtained in step (a) to temperature between 0 and −25° C.;

c) separating of the solids and liquid obtained in step (b) by filtration;

d) concentrating the filtrate obtained in step (c) by partial removal of solvent;

e) adding a hydrocarbon solvent to the contents obtained in step (d), and separating the solids obtained from the hydrocarbon-methanol layers by filtration or decanting;

f) separating the hydrocarbon layer by draining away the lower methanol layer, washing the hydrocarbon layer with water, and further separating the hydrocarbon solvent layer by draining away the water layer;

g) removing solvent from the hydrocarbon layer obtained in step (f) by low vacuum distillation;

h) distilling the contents obtained in step (g) at about 85-100° C., 0.1 Pa to remove free fatty acids as distillate;

i) distilling the residue obtained in step (h) at about 100-170° C., 0.1 Pa to obtain tocotrienol concentrate as distillate;

j) washing thoroughly the residue obtained in step (c) with methanol or ethanol or methanol-ethanol mixture;

k) removing solvent from the alcoholic solution obtained in step (j);

l) dissolving the contents obtained in step (k) in hydrocarbon solvent, washing the solution with water, and separating the hydrocarbon solvent layer by draining away the water layer;

m) removing solvent from the hydrocarbon layer obtained in step (l) by low vacuum distillation;

n) distilling the contents obtained in step (m) at about 85-100° C., 0.1 Pa to remove free fatty acids as distillate; and o) distilling the residue obtained in step (n) at about 100-170° C., 0.1 Pa to obtain tocotrienol concentrate as distillate.

2. The process for the recovery of tocols from oils and fats as claimed in claim 1, wherein methanol or ethanol or methanol-ethanol mixture was used for liquid-liquid extraction and urea is subsequently added to the alcohol extract.

3. The process for the recovery of tocols from oils and fats as claimed in claim 1, wherein the oils and fats are palm oil; rice bran oil; palm kernel oil; coconut oil; cocoa butter; and/or oil extracted from annatto beans, wheat germs, oats, barley and/or rye.

4. A process for the recovery of fatty acids, monoacylglycerols and diacylglycerols from oils and fats, said process comprising of the steps of:

a) adding a hydrocarbon solvent to the residue obtained in step (j) of claim 1 and filtering the resulting solution;

b) removing solvent from the contents soluble in hydrocarbon solvent obtained in step (a) by low vacuum distillation to obtain a mixture of fatty acids, monoacylglycerols, diacylglycerols and sterols;

c) distilling the mixture obtained in step (b) at about 85-100° C., 0.1 Pa to remove free fatty acids as distillate;

d) distilling the residue obtained in step (c) at about 100-170° C., 0.1 Pa to obtain monoacylglycerols concentrate as distillate; and e) distilling the residue obtained in step (d) at greater than about 170° C., 0.1 Pa to obtain diacylglycerols concentrate as distillate.

5. The process for the recovery of tocols from oils and fats as claimed in claim 1, wherein the distilling of step (h) and/or step (n) is carried out at about 90-100° C., 0.1 Pa.

6. The process for the recovery of tocols from oils and fats as claimed in claim 1, wherein the distilling of step (i) and/or step (o) is carried out at about 100-150° C., 0.1 Pa.

7. The process for the recovery of tocols from oils and fats as claimed in claim 6, wherein the distilling of step (i) and/or step (o) is carried out at about 100-135° C., 0.1 Pa.

8. The process for the recovery of tocols from oils and fats as claimed in claim 6, wherein the distilling of step (i) and/or step (o) is carried out at about 135-150° C., 0.1 Pa.

9. The process for the recovery of tocols from oils and fats as claimed in claim 1, wherein the distilling of step (i) and/or step (o) is carried out at about 135 0° C., 0.1 Pa.

10. The process for the recovery of tocols from oils and fats as claimed in claim 1, wherein the process does not involve a saponification, esterification or transesterification step.

11. The process for the recovery of tocols from oils and fats as claimed in claim 1, wherein the tocotrienol concentrate obtained contains naturally occurring monoacylglycerols and/or diacylglycerols as a naturally occurring emulsifier and dispersion agent.

12. The process for the recovery of tocols from oils and fats as claimed in claim 1, wherein the urea solution contains at least about 2.5% w/v urea.

13. The process for the recovery of tocols from oils and fats as claimed in claim 1, wherein the urea solution contains at least about 5% w/v urea.

14. The process for the recovery of tocols from oils and fats as claimed in claim 1, wherein the urea solution contains at least about 10% w/v urea.

15. The process for the recovery of fatty acids, monoacylglycerols and diacylglycerols from oils and fats as claimed in claim 4, wherein the distilling of step (c) is carried out at about 90-100° C., 0.1 Pa.

16. The process for the recovery of fatty acids, monoacylglycerols and diacylglycerols from oils and fats as claimed in claim 4, wherein the distilling of step (d) is carried out at about 100-150° C., 0.1 Pa.

17. The process for the recovery of fatty acids, monoacylglycerols and diacylglycerols from oils and fats as claimed in claim 16, wherein the distilling of step (d) is carried out at about 100-135° C., 0.1 Pa.

18. The process for the recovery of fatty acids, monoacylglycerols and diacylglycerols from oils and fats as claimed in claim 16, wherein the distilling of step (d) is carried out at about 135-150° C., 0.1 Pa.

19. The process for the recovery of fatty acids, monoacylglycerols and diacylglycerols from oils and fats as claimed in claim 4, wherein the distilling of step (d) is carried out at about 135° C., 0.1 Pa.

20. The process for the recovery of fatty acids, monoacylglycerols and diacylglycerols from oils and fats as claimed in claim 4, wherein the distilling of step (e) is carried out at about 175° C.

* * * * *